US009521863B2

(12) United States Patent
Lusso et al.

(10) Patent No.: US 9,521,863 B2
(45) Date of Patent: Dec. 20, 2016

(54) METHODS OF REDUCING TOBACCO-SPECIFIC NITROSAMINES (TSNAS) AND/OR IMPROVING LEAF QUALITY IN TOBACCO

(71) Applicant: Altria Client Services LLC, Richmond, VA (US)

(72) Inventors: Marcos Fernando de Godoy Lusso, Chesterfield, VA (US); Alec Hayes, Chesterfield, VA (US); Kenny Lion, Richmond, VA (US); Greg Davis, Midlothian, VA (US); Jerry Whit Morris, Jetersville, VA (US); Robert Frank Hart, III, Midlothian, VA (US)

(73) Assignee: ALTRIA CLIENT SERVICES LLC, Richmond, VA (US)

( * ) Notice: Subject to any disclaimer, the term of this patent is extended or adjusted under 35 U.S.C. 154(b) by 479 days.

(21) Appl. No.: 13/831,117

(22) Filed: Mar. 14, 2013

(65) Prior Publication Data

US 2014/0076339 A1 Mar. 20, 2014

Related U.S. Application Data

(60) Provisional application No. 61/702,986, filed on Sep. 19, 2012.

(51) Int. Cl.

| | |
|---|---|
| ***A24B 1/02*** | (2006.01) |
| ***A24B 15/10*** | (2006.01) |
| ***A24B 15/24*** | (2006.01) |

(52) U.S. Cl.

CPC ..... *A24B 1/02* (2013.01); *A24B 15/10* (2013.01); *A24B 15/245* (2013.01)

(58) Field of Classification Search

USPC ..... 131/290, 352, 3, 60, 366; 34/282, 443

See application file for complete search history.

(56) References Cited

U.S. PATENT DOCUMENTS

| | | | | |
|---|---|---|---|---|
| 3,927,683 | A | 12/1975 | Wilson et al. | |
| 4,528,993 | A | 7/1985 | Sensabaugh, Jr. et al. | |
| 4,660,577 | A | 4/1987 | Sensabaugh et al. | |
| 4,848,373 | A | 7/1989 | Lenkey | |
| 5,125,420 | A | 6/1992 | Livingston | |
| 5,372,149 | A | 12/1994 | Roth et al. | |
| 6,202,649 | B1 * | 3/2001 | Williams | 131/303 |
| 6,311,695 | B1 * | 11/2001 | Williams | 131/299 |

(Continued)

FOREIGN PATENT DOCUMENTS

| | | |
|---|---|---|
| FR | 2773305 | 7/1999 |
| WO | WO 00/15056 | 3/2000 |

(Continued)

OTHER PUBLICATIONS dE Roton et al, "Factors Influencing the Formation of Tobacco-Specific Nitrosamines in French Air-Cured Tobacco in Trials and at the Farm Level", Beitrage zur Tabakforschung International/Contributions to Tobacco Research, v. 21, No. 6, Jul. 6, 2005, pp. 306 to 320).*

(Continued)

*Primary Examiner* — Dennis Cordray

(74) *Attorney, Agent, or Firm* — Fish & Richardson P.C.

(57) ABSTRACT

Methods of curing tobacco that reduce the levels of TSNAs and/or improve leaf quality are described herein.

24 Claims, 17 Drawing Sheets

(56) References Cited

U.S. PATENT DOCUMENTS

| | | | | |
|---|---|---|---|---|
| 6,755,200 | B1 * | 6/2004 | Hempfling et al. | 131/309 |
| 7,293,564 | B2 * | 11/2007 | Perfetti et al. | 131/296 |
| 7,992,575 | B2 * | 8/2011 | Cui et al. | 131/290 |
| 2001/0000386 | A1 | 4/2001 | Peele | |
| 2004/0118422 | A1 | 6/2004 | Lundin et al. | |
| 2005/0178398 | A1 | 8/2005 | Breslin et al. | |
| 2005/0244521 | A1 | 11/2005 | Strickland et al. | |
| 2006/0191548 | A1 | 8/2006 | Strickland et al. | |
| 2007/0149408 | A1 | 6/2007 | Thomas et al. | |
| 2010/0154810 | A1 | 6/2010 | Williams | |
| 2012/0024301 | A1 | 2/2012 | Carroll et al. | |
| 2012/0031414 | A1 | 2/2012 | Atchley et al. | |
| 2012/0031416 | A1 | 2/2012 | Atchley et al. | |

FOREIGN PATENT DOCUMENTS

| | | |
|---|---|---|
| WO | WO 01/35770 | 5/2001 |
| WO | WO 2008/076802 | 6/2008 |

OTHER PUBLICATIONS

"Gases—Explosive and Flammability Concentration Limits", The Engineering Toolbox, [online], no date, retrieved from the Internet, [retrieved Jul. 18, 2015], <URL: http://www.engineeringtoolbox.com/explosive-concentration-limits-d_423.html>.*

International Search Report and Written Opinion in International Application No. PCT/US2013/060694, mailed Feb. 6, 2014, 11 pages.

Chaplin, "Inheritance and Possible Use of Pale Yellow Character in Tobacco," Crop Sci., 1969, 9:169-72.

Chaplin, "Interrelationships Between the Pale-Yellow Character and Other Traits in Flue-Cured Tobacco," Crop Sci., 1977, 17:21-22.

Legacy Tobacco Document Library (Bates Document # 523267826/7833, Jul. 1, 1988, Memorandum on the Proposed Burley Tobacco Grade Index), 8 pages.

Legg, "Registration of IG KY 171 and IG KY 160 Tobacco Germplasm Lines," 1995, Crop Sci., 35:601-2.

* cited by examiner

METHODS OF REDUCING TOBACCO-SPECIFIC NITROSAMINES (TSNAS) AND/OR IMPROVING LEAF QUALITY IN TOBACCO

CROSS-REFERENCE TO RELATED APPLICATIONS

This application claims priority to U.S. Provisional Application Ser. No. 61/702,986, filed on Sep. 19, 2012. The disclosure of the prior application is considered part of (and is incorporated by reference in) the disclosure of this application.

TECHNICAL FIELD

This disclosure generally relates to methods used to avoid formation of TSNAs in tobacco and/or improve leaf quality during curing.

BACKGROUND

Cured tobacco is the result of many physical and chemical changes that transform tobacco from green, high-moisture leaf obtained at harvest to aromatic, low-moisture leaf that is sold and used in adult consumer tobacco products. Physical and chemical changes begin even before tobacco is harvested in the field; as leaves ripen and begin the process of leaf senescence, chemical changes begin and continue even after the tobacco is cut and hung in a barn to cure. Therefore, there are many environmental conditions, before and after harvesting, that can influence the properties of cured tobacco.

SUMMARY

Methods of curing tobacco that reduce the levels of TSNAs and/or improve leaf quality are described herein.

In one aspect, a method of curing harvested tobacco is provided. Such a method typically includes housing harvested tobacco in a curing barn; and reducing the relative humidity in the barn to 80% or less and/or reducing the relative water activity in the tobacco to 0.9 or less. In some embodiments, the relative humidity in the barn is reduced to 85% or less and/or the relative water activity in the tobacco is reduced to 0.85 or less. In some embodiments, the relative humidity in the barn is reduced to 90% or less and/or the relative water activity in the tobacco is reduced to 0.80 or less.

In some embodiments, the relative humidity and/or the relative water activity is reduced within 48 hours of the housing step. In some embodiments, the relative humidity and/or the relative water activity is reduced within 24 hours of the housing step. In some embodiments, the relative humidity and/or the relative water activity is reduced within 12 hours of the housing step.

Generally, such methods reduce the level of at least one tobacco-specific nitrosamine (TSNA) in the cured tobacco. Representative TSNAs include, without limitation, N'-nitrosonornicotine (NNN), 4-(N-nitrosomethylamino)-1-(3-pyridyl)-1-butanone (NNK), N'-nitrosoanatabine (NAT) and N'-nitrosoanabasine (NAB). In some embodiments, the tobacco is dark fire-cured. In some embodiments, the tobacco is air-cured. In some embodiments, the tobacco is partially yellowed at the housing step. In some embodiments, the tobacco is pale-yellow tobacco (e.g., the tobacco comprises a pale-yellow gene).

In another aspect, a method of curing harvested tobacco is provided. Such a method typically includes housing tobacco in a curing barn; and drying tobacco under conditions that reduce the level of at least one TSNA, wherein the conditions comprise increasing the temperature and decreasing the percent relative humidity and/or the relative water activity within 48 hours of the housing step. In some embodiments, the conditions comprise increasing the temperature and decreasing the percent relative humidity and/or the relative water activity within 24 hours of the housing step. In some embodiments, the conditions comprise increasing the temperature and decreasing the percent relative humidity and/or the relative water activity within 12 hours of the housing step.

Representative TSNAs include, without limitation, N'-nitrosonornicotine (NNN), 4-(N-nitrosomethylamino)-1-(3-pyridyl)-1-butanone (NNK), N'-nitrosoanatabine (NAT) and N'-nitrosoanabasine (NAB). In some embodiments, the tobacco is dark fire-cured. In some embodiments, the tobacco is air-cured. In some embodiments, the tobacco is partially yellowed at the housing step. In some embodiments, the tobacco is pale-yellow tobacco (e.g., the tobacco comprises a pale-yellow gene).

In yet another aspect, cured tobacco made by the methods described herein is provided. Also provided are tobacco products that include cured tobacco made by the methods described herein. Representative tobacco products include, for example, a smokeless tobacco product, a cigarette product, a cigar product, loose tobacco, and tobacco-derived nicotine products.

In one aspect, a method of curing dark tobacco is provided. Such a method typically includes growing dark tobacco plants in a field, where the tobacco plants carry at least one pale-yellow gene; harvesting the plants and housing them in a barn; and fire-curing the plants (e.g., under conventional fire-curing conditions or under flash fire-curing conditions described herein).

In another aspect, a method of curing dark tobacco is provided. Such a method generally includes contacting (e.g., spraying) dark tobacco plants in a field with an ethylene-type plant growth regulator; harvesting the plants and housing them in a barn; and fire-curing the plants (e.g., under conventional fire-curing conditions or under flash fire-curing conditions described herein). A representative ethylene-type plant growth regulator is ETHEPHON. Typically, the contacting step is performed once, but can be performed multiple times.

Unless otherwise defined, all technical and scientific terms used herein have the same meaning as commonly understood by one of ordinary skill in the art to which the methods and compositions of matter belong. Although methods and materials similar or equivalent to those described herein can be used in the practice or testing of the methods and compositions of matter, suitable methods and materials are described below. In addition, the materials, methods, and examples are illustrative only and not intended to be limiting. All publications, patent applications, patents, and other references mentioned herein are incorporated by reference in their entirety.

DESCRIPTION OF DRAWINGS

Part A

FIG. 8A shows the temperature and percent relative humidity in Barn1, while

Part B

Figure 9:
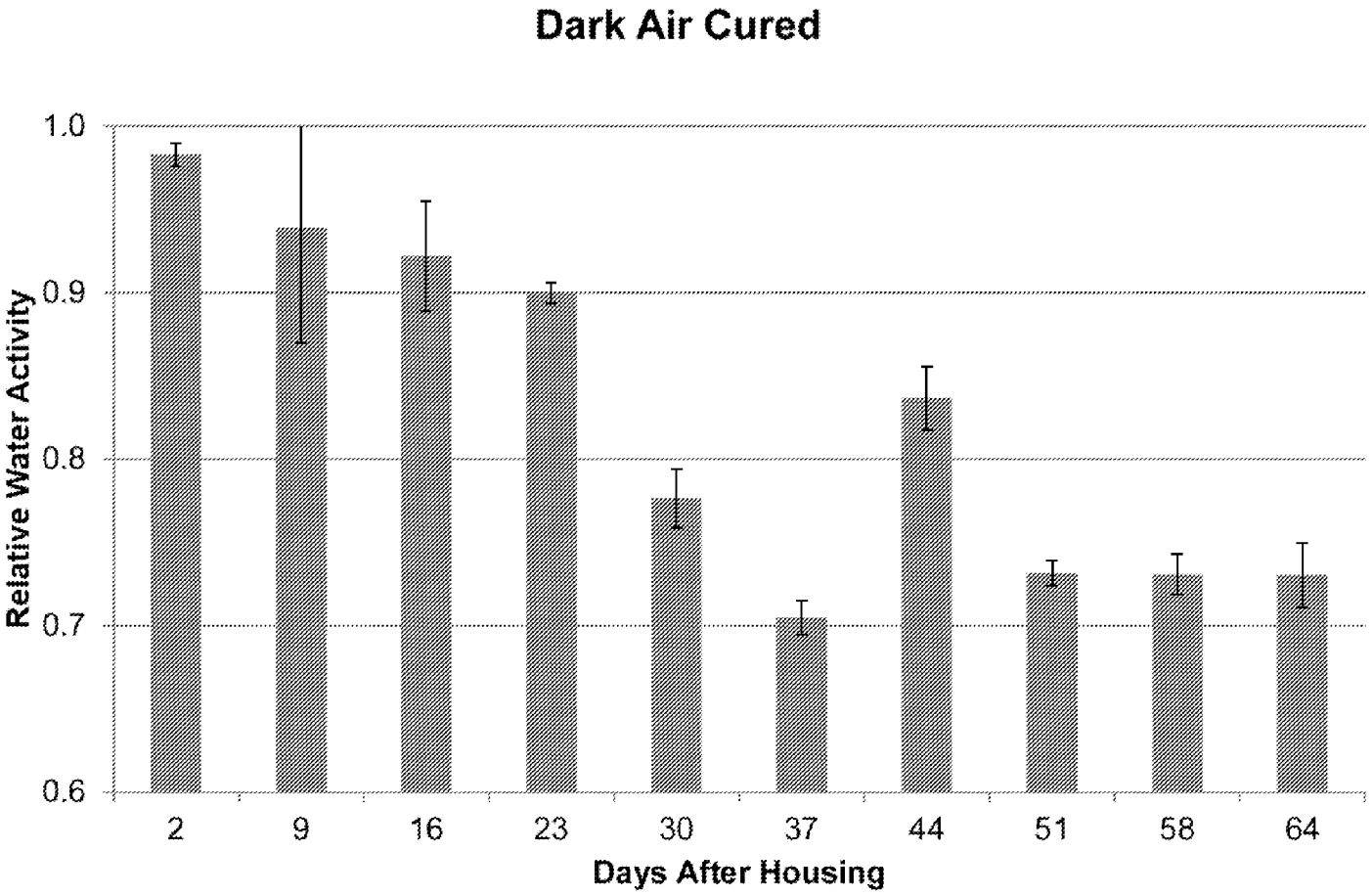

FIG. 9 is a graph showing the effect air curing has on the relative water activity in the tobacco leaves.

Figure 10A:
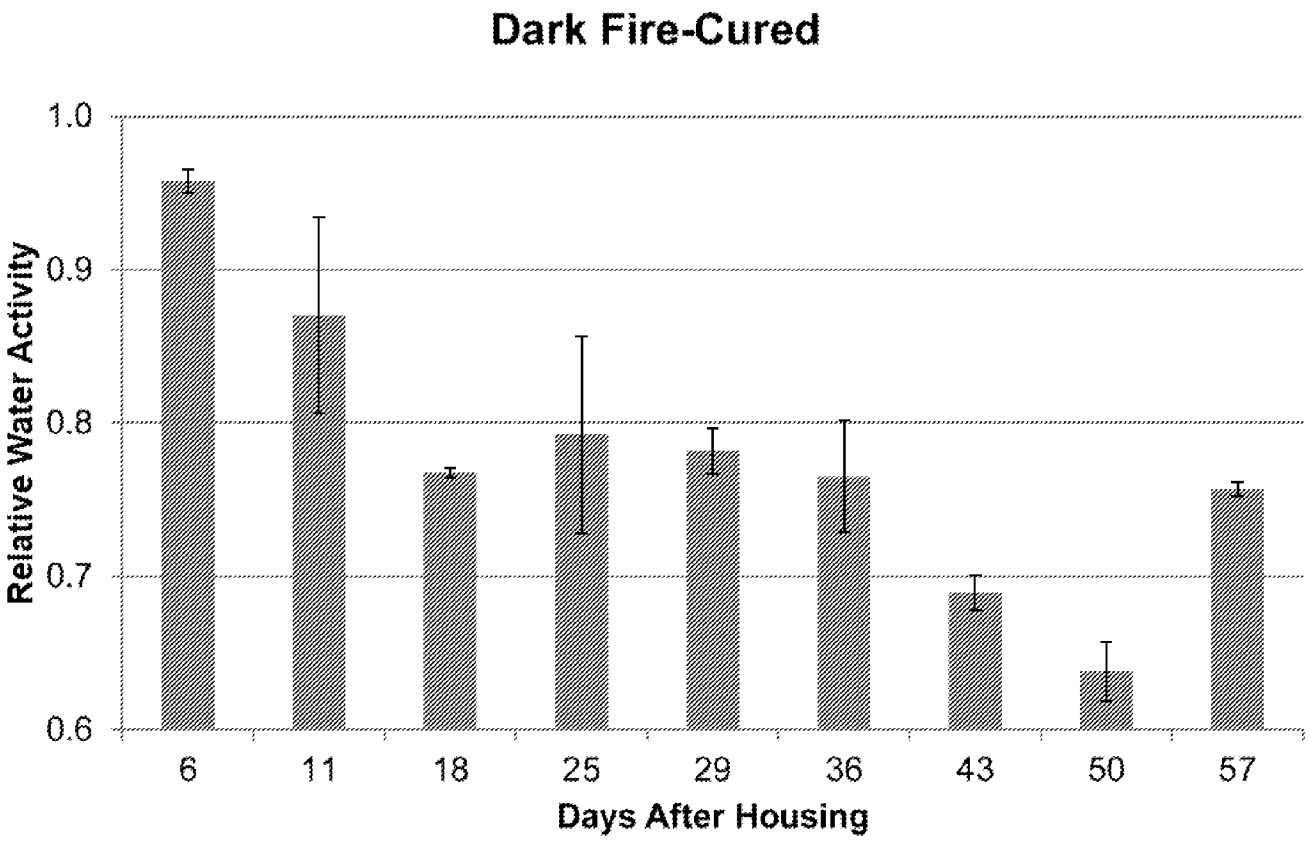
Figure 10B:
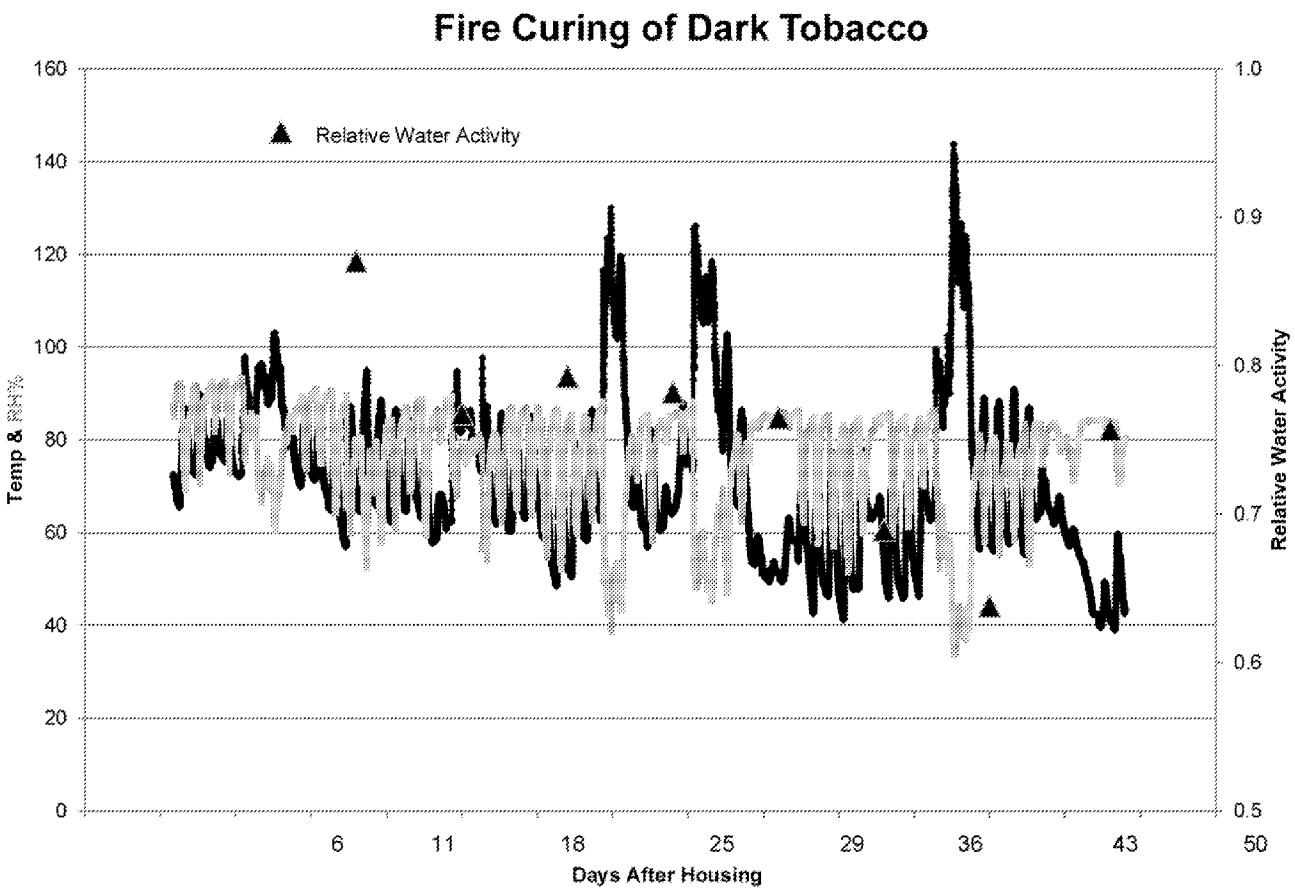

FIG. 10A is a graph showing the effect fire-curing has on the relative water activity in the tobacco leaves; FIG. 10B is a graph that also includes temperature (blue) and relative humidity (red).

Figure 11A:
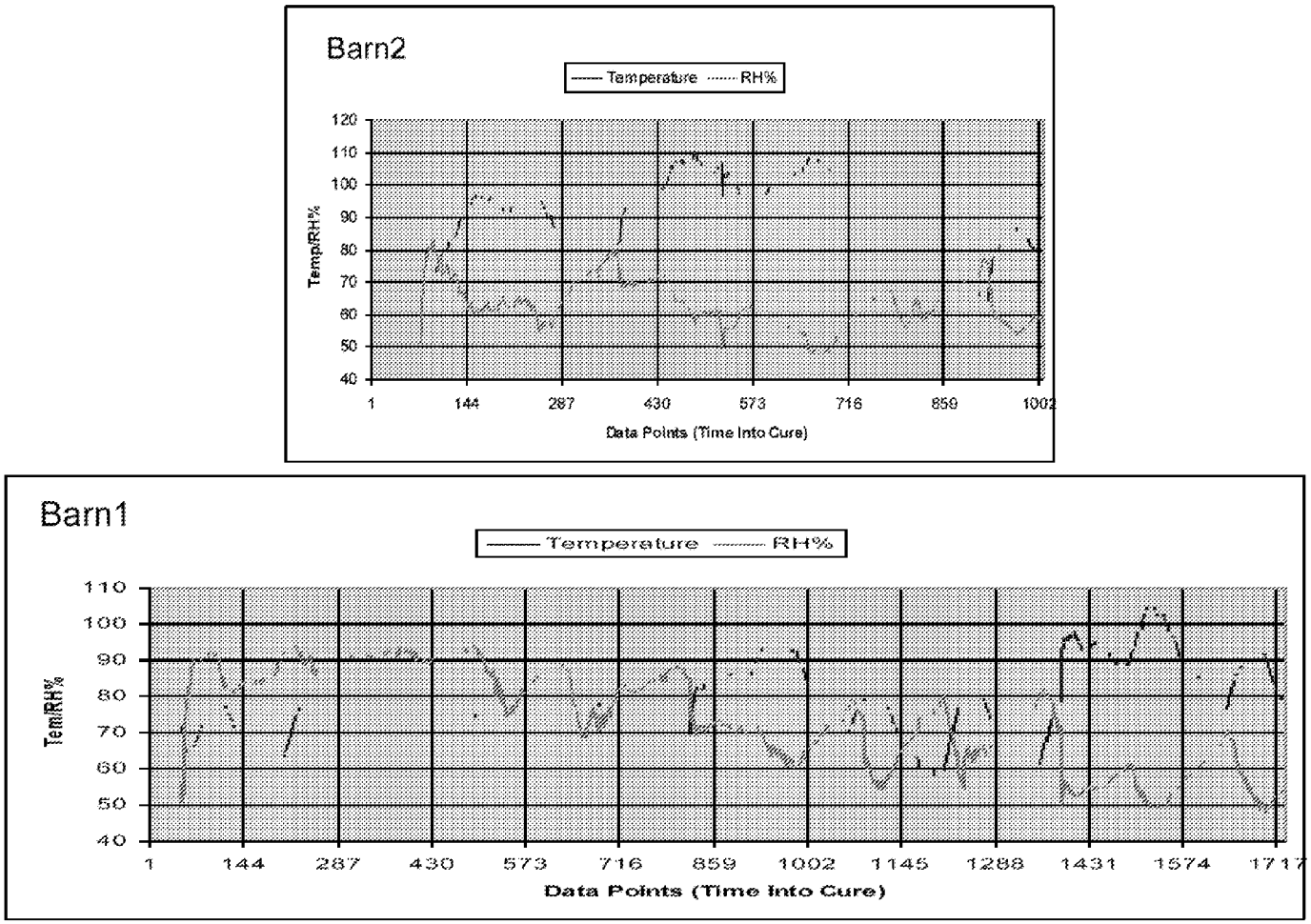
Figure 11B:
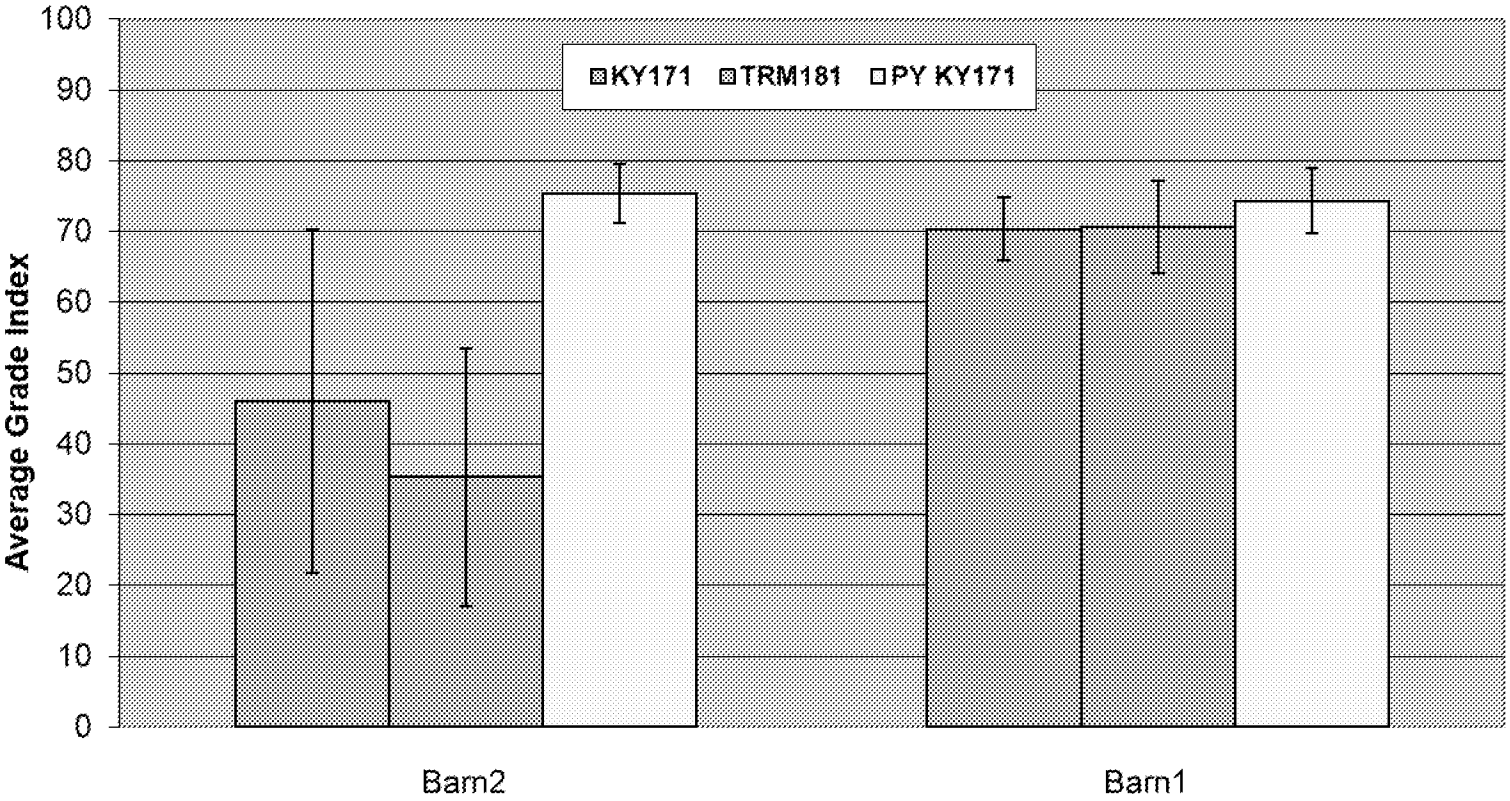
Figure 11C:
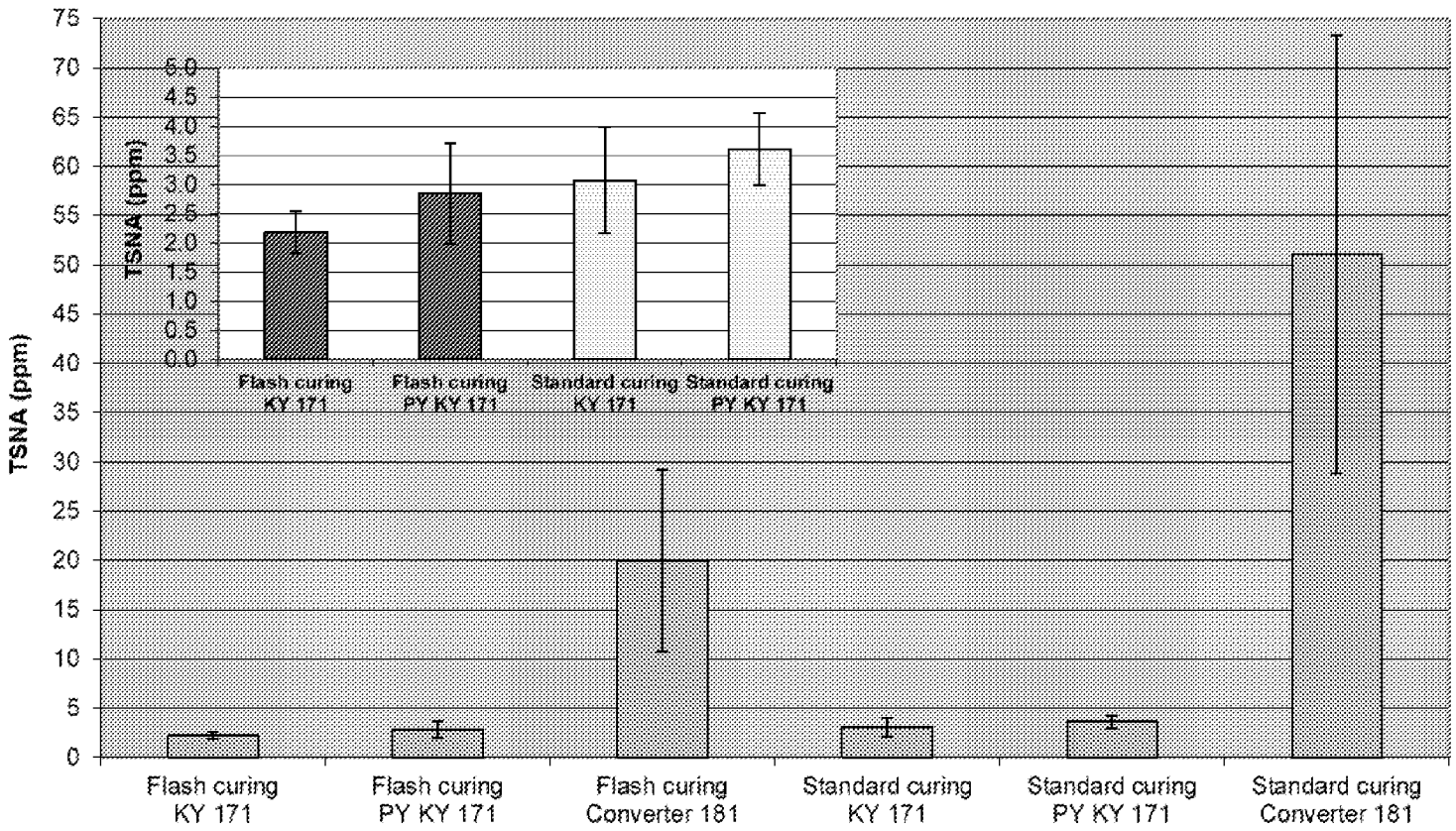

FIG. 11A is a graph showing the temperature (blue) and relative humidity (red) in Barn1 (bottom) vs. Barn2 (top). FIG. 11B is a graph showing the average grade index of tobacco leaves in Barn1 vs. Barn2. FIG. 11C is a graph that shows the TSNA levels in Barn1 ("standard curing") vs. Barn2 ("flash curing").

DETAILED DESCRIPTION

Curing methods allow for the slow oxidation and degradation of carotenoids in the tobacco leaf. This produces various compounds in the tobacco leaves that give cured tobacco its sweet hay, tea, rose oil, or fruity aromatic flavor that contributes to the end product consumed by adult tobacco consumers. Curing methods vary with the type of tobacco, but generally include air-curing, fire-curing, and flue-curing. The following are meant to be representative examples of curing methods and are not meant to limit the methods described herein for reducing TSNAs.

Burley Air-Cured Tobacco

Leaf quality of air-cured tobacco is influenced by moisture and temperature conditions inside the curing facility during the curing period. Control of the curing process is affected mainly by spacing of the tobacco in the curing facility and management of the drying rate. The drying rate is controlled primarily by operating the ventilators, plastic covering, or other air control means to regulate the ventilation rates.

With respect to burley, curing studies on the effect of low and high temperatures and relative humidity can be summarized as follows: 1) low temperatures result in green leaf, regardless of the relative humidity and airflow. The chemical conversions are slow because of the low temperature, but the drying rate determines the degree of green cast in the leaf. Therefore, the higher the drying rate, the greener the cured leaf; 2) low humidity and moderate temperature results in greenish or mottled leaf; 3) low humidity and high temperature (75° F. and above) causes yellowish ("piebald") leaf; and 4) high humidity and moderate-to-high temperature for extended periods can result in "house-burning". Houseburn results in a dark leaf with excessive loss in dry weight, primarily caused by the action of microorganisms that cause soft rot. Thus, it was concluded that temperature determines the undesirable colors in the cured leaf during improper curing, however, it is the relative humidity (if airflow is adequate) that determines the degree of damage incurred.

Dark Air-Cured Tobacco

Dark tobacco is grown primarily in Kentucky, Virginia and Tennessee, and is predominantly used in smokeless tobacco products. Dark tobacco generally has larger, thicker leaves than, for example, Burley tobacco. Dark tobacco grows more prostrate than other tobacco varieties, is topped lower, but requires wider spacing in rows.

Curing methods for dark air-cured tobacco are essentially the same as curing methods for burley, but because of the heavier body of dark tobacco, dark air-cured tobacco is more prone to sweat, houseburn and mold. Under warm conditions (mean daytime temperatures >80° F. and mean nighttime temperatures >60° F.), barn doors and ventilators usually are open during the early stages of curing to promote airflow through the tobacco.

Dark Fire-Cured Tobacco

Dark fire-cured tobacco goes through several stages while curing: yellowing, color setting, stem drying and finishing. During yellowing, which can last from about 5 days to about 8 days, ventilation should be provided as needed such that temperatures do not exceed 100° F., while during color setting, which can last from about one to two weeks, little to no ventilation should be provided and a temperature of 100° F.-115° F. should be reached. During stem drying, which can last from about 4 days to about 8 days, full ventilation is provided and temperatures should not exceed 130° F., while during finishing, which can last from about 10 days to about 14 days, no ventilation is necessary and temperatures should not exceed 120° F.

A typical practice for harvesting dark tobacco is to cut the plants late in the afternoon and allow them to wilt on the ground overnight before spiking. This practice is used to avoid sunburn, which occurs when dark tobacco is exposed to high sunlight intensity during the hot period of the day and results in an undesirable crude green color in the cured leaf. After spiking, tobacco is placed on scaffold wagons, which are kept in the shade for up to 48 hours to further wilt the tobacco before it is housed in the curing barn. Sufficient wilting is important to minimize leaf breakage and to facilitate handling of the plants between spiking and housing; sufficiently wilted tobacco also is less likely to sweat and house burn, and will yellow and cure better. Sufficient wilting before housing also reduces the moisture that is brought into the barn, which ultimately restricts the growth of nitrate-reducing microorganisms (see below).

Growers would prefer to begin housing dark tobacco (e.g., air-curing or fire-curing) when it is as far along in the yellowing phase as possible. Delaying the curing process to wait for tobacco to finish yellowing, however, can result in an increase in the nitrate-reducing microorganisms, yet curing the tobacco before yellowing is completed can cause "bluing" of the tobacco, which results in an undesirable color. In addition, improperly curing dark tobacco can result in "green" tobacco. While several pre-harvesting factors can lead to "green" tobacco, the most critical ones occur in the barn during curing. For example, if not managed correctly, relative humidity, temperature, and/or airflow, all of which affect the rate of leaf drying, can lead to "green" tobacco and also can affect TSNA levels.

TSNAs and Methods to Reduce TSNAs During Curing

Several tobacco-specific nitrosamines (TSNAs) have been identified, but interest has focused on NNN (N'-nitrosonornicotine), NNK (4-(N-nitrosomethylamino)-1-(3-pyridyl)-1-butanone), NAT (N'-nitrosoanatabine) and NAB (N'-nitrosoanabasine). Of these, NNN is the most important in burley and dark tobaccos. Negligible amounts of TSNAs are present in freshly harvested green tobacco. TSNAs are mainly formed during curing, specifically during the late yellowing to early browning stage. TSNAs are formed as a result of the nitrosation of tobacco alkaloids in the presence of nitrogen oxides (NOx). For example, NNN is formed by the nitrosation of the alkaloid, nornicotine. The nitrosating agent in air-cured tobacco is usually nitrite, derived from the reduction of leaf nitrate by the action of microbes during curing, referred to as nitrate-reducing microorganisms. In fire-cured tobacco, the nitrosating agents are both nitrite and any of several nitrogen oxides formed during the fire-curing process.

TSNA formation is a complex process involving a number of factors. The following is a partial list of practices that can result in reducing TSNA levels. See, for example, 2011-2012 Kentucky & Tennessee Tobacco Production Guide.

- use no more nitrogen than necessary to optimize yield;
- avoid spring applications of muriate fertilizers;
- top plants correctly;
- harvest at correct maturity, ideally four weeks after topping for burley, five weeks for dark air-cured and seven weeks for dark fire-cured;
- do not cut wet tobacco;
- do not house tobacco that has free moisture on the leaves;
- avoid overcrowding the barn, and space sticks, and the plants on the sticks, evenly;
- manage air-curing carefully, ensuring adequate but not excessive ventilation;
- fire dark tobacco no more than necessary;
- start firing dark fire-cured tobacco by seven days after housing;
- do not allow temperatures in fire-cured barns to exceed 130° F.; or
- do not keep temperatures in fire-cured barns at 130° F. for longer than four to five days.

As described herein, despite the environmental factors, certain management practices can be used during the curing process to lower or reduce TSNAs in tobacco. For example, growers can increase the temperature (e.g., starting the first fire) within 48 hours after housing the tobacco (e.g., within 24 hours after housing; within 12 hours after housing; or immediately (i.e., within 2-3 hours) after housing the tobacco). Alternatively or additionally, growers can reduce the relative humidity in the barn to 80% or less (e.g., 60%, 65%, 70%, or 75% relative humidity). In some embodiments, growers can reduce the relative humidity in the barn to 85% or less, or to 90% or less. Alternatively or additionally, growers can reduce the relative water activity ($a_w$) in the plants to, for example, 0.90 or less (e.g., 0.89, 0.88, 0.87, 0.86, 0.85, 0.84, 0.83, 0.82, 0.81, or 0.80). It is noted that, according to Aqualab (see, for example, aqualab.com/applications/microbial-growth/on the World Wide Web), common spoilage bacteria require at least a water activity level of 0.91 for growth. Without being bound by any theory, the methods described herein likely result in conditions that reduce or eliminate the number of nitrate-reducing microorganisms or their ability to reduce nitrate.

Tobacco cured using the methods described herein has "reduced TSNA levels" relative to tobacco cured using the methods recommended in the 2011-2012 Kentucky & Tennessee Tobacco Production Guide, referred to herein as "conventional curing methods." Typically, tobacco that has been cured using the methods described herein has statistically significantly less TSNAs than tobacco that has been cured using conventional curing methods. As used herein, "statistically significant" refers to a p-value of less than 0.05, e.g., a p-value of less than 0.025 or a p-value of less than 0.01, using an appropriate measure of statistical significance, e.g., a one-tailed two sample t-test.

Leaf Quality and Methods of Improving Leaf Quality During Curing

The pale-yellow character in tobacco was first described by Chaplin (1969, Crop Sci., 9:169-72) and was determined to be controlled by a single dominant gene. Plants containing a pale-yellow gene exhibit accelerated leaf senescence and/or chlorophyll degradation relative to normal green plants. Consequently, the pale-yellow trait has been studied for its potential use to improve the efficiency of harvesting of flue-cured tobacco. For example, research has shown that pale-yellow tobacco can be harvested in two primings compared to four or five for green flue-cured cultivars. In addition, the interrelationship between the pale-yellow trait and certain agronomic and chemical traits of flue-cured tobaccos has been described (see, for example, Chaplin, 1977, Crop Sci., 17:21-22). For example, compared to normal green tobacco, pale-yellow tobacco contained lower reducing sugar and starch levels, higher levels of alpha-amino nitrogen, and resulted in slightly reduced yields.

The pale-yellow gene can be introduced (e.g., by introgression) into any desired tobacco variety using conventional plant breeding methods. For example, TI 1372 is a publicly available pale-yellow tobacco variety. Thus, TI 1372 or another pale-yellow variety can be used as the source of the pale-yellow gene (i.e., a first variety) in crosses with another variety (i.e., a second variety). TI 1372 seed and seed from other varieties can be obtained, for example, from USDA Nicotiana Germplasm Collection (online catalog at ars-grin.gov/npgs on the World Wide Web).

The second variety can be, for example, an agronomically elite variety exhibiting, for example, desirable crop traits including, but not limited to, high yield, disease resistance, drought tolerance, sugar content, leaf size, leaf width, leaf length, leaf quality, leaf color, leaf reddening, leaf yield, internode length, flowering time, lodging resistance, stalk thickness, high grade index, curability, curing quality, mechanical harvestability, holding ability, height, maturation, stalk size, and leaf number per plant. Methods of crossing plants are well known in the art and include, without limitation, hand pollination of female stigma from one variety with pollen from a second variety.

The F1 progeny plants resulting from such a cross can be backcrossed or self-pollinated. For example, F1 progeny can be allowed to self-pollinate for at least one generation (e.g., one, two, three, four, five or six generations) and/or F1 progeny plants can be backcrossed to one of the parents (e.g., BC1, BC2, BC3, and subsequent generation plants). Progeny refers to descendants from a cross between particular plants or plant varieties, e.g., seeds developed on a particular plant. Progeny also include seeds formed on F2, F3, and subsequent generation plants. Other breeding techniques also can be used to make a pale-yellow tobacco variety. Such methods include, but are not limited to, single seed descent, production of di-haploids, pedigree breeding, and recombinant technology using transgenes. Progeny plants resulting from any such crosses can be screened for the pale-yellow trait. See, for example, Gwynn et al., 1970, Crop Sci., 171:23-5.

Alternatively, a tobacco variety not carrying the pale-yellow gene (e.g., a wild type tobacco variety) can be mutagenized using methods known in the art. Mutations can be induced in living organisms or in cultured cells by a variety of mutagens, including ionizing radiation, ultraviolet radiation, or chemical mutagens, by infection with certain viruses which integrate into the host genome, or by the introduction of nucleic acids previously mutagenized in vitro. Plants regenerated from mutagenized plants or plant cells can be allowed to self-pollinate and the progeny then screened for those plants exhibiting the pale-yellow trait.

Hybrid tobacco varieties can be produced by preventing self-pollination of female parent plants (i.e., seed parents) of a first variety, permitting pollen from male parent plants of a second variety to fertilize the female parent plants, and allowing F1 hybrid seeds to form on the female plants. Self-pollination of female plants can be prevented by emasculating the flowers at an early stage of flower development. Alternatively, pollen formation can be prevented on the female parent plants using a form of male sterility. For example, male sterility can be produced by cytoplasmic male sterility (CMS), nuclear male sterility, genetic male sterility, molecular male sterility wherein a transgene inhibits microsporogenesis and/or pollen formation, or self-incompatibility. Female parent plants containing CMS are particularly useful.

As demonstrated herein, the pale-yellow gene can significantly improve the leaf quality following curing (e.g., air-curing, fire-curing, flue-curing; e.g., conventional curing or flash curing). Leaf quality can be determined, for example, using an Official Standard Grade published by the Agricultural Marketing Service of the US Department of Agriculture (7 U.S.C. §511); Legacy Tobacco Document Library (Bates Document #523267826/7833, Jul. 1, 1988, Memorandum on the Proposed Burley Tobacco Grade Index); and Miller et al., 1990, Tobacco Intern., 192:55-7.

Another method that can be used to improve the process of curing tobacco is to spray or otherwise apply an ethylene-type plant growth regulator onto tobacco plants before harvesting. The ethylene-type plant growth regulator causes the tobacco plants to senesce earlier, thereby reducing the chlorophyll content. Such plants are less prone to sunburn, which allows growers to wilt the tobacco in the sun longer, which, in turn, reduces the amount of moisture brought into the barn and present during curing. Representative ethylene-type plant growth regulators include, without limitation, 2-chloroethylphosphonic acid (sold commercially as ETHEPHON by, for example, Bayer Crop Science (Research Triangle Park, N.C.) or Sigma-Aldrich (St. Louis, Mo.)). Generally, a single application of an ethylene-type plant growth regulator is sufficient, however, one or more ethylene-type growth regulators can be applied to the tobacco plants more than once (e.g., twice, three times, or more) if desired.

Tobacco Products

Tobacco (e.g., green tobacco or pale-yellow tobacco) cured using the methods described herein can be aged and processed in the same manner as tobacco cured using "conventional curing methods". In addition, such tobacco can be used alone or blended with tobacco cured using "conventional curing methods." As used herein, blends refer to combinations of tobaccos that have 50%-99% of one or more of the tobaccos described herein (e.g., 50%-60%, 55%-65%, 60%-70%, 75%-85%, 80%-85%, 80%-90%, 85%-95%, 90%-99%, or 95%-99%).

In some embodiments, tobacco (e.g., green tobacco or pale-yellow tobacco) cured as described herein can be conditioned and/or fermented. Conditioning includes, for example, a heating, sweating or pasteurization step as described in US 2004/0118422 or US 2005/0178398. Fermenting typically is characterized by high initial moisture content, heat generation, and a 10 to 20% loss of dry weight. See, e.g., U.S. Pat. Nos. 4,528,993, 4,660,577, 4,848,373 and, 5,372,149. Cured, or cured and fermented, tobacco as described herein also can be further processed (e.g., cut, expanded, blended, milled or comminuted).

Tobacco (e.g., green tobacco or pale-yellow tobacco) cured using the methods described herein or a blend of tobacco that includes such tobacco can be used in any number of adult-consumer tobacco products. Without limitation, adult-consumer tobacco products include smokeless tobacco products, cigarette products, cigar products, loose tobacco, and tobacco-derived nicotine products. Representative smokeless tobacco products include, for example, chewing tobacco, snus, pouches, films, tablets, sticks, rods, and the like. See, for example, US 2005/0244521, US 2006/0191548, US 2012/0024301, US 2012/0031414, and US 2012/0031416 for examples of tobacco products.

In accordance with the present invention, there may be employed conventional molecular biology, microbiology, biochemical, and recombinant DNA techniques within the skill of the art. Such techniques are explained fully in the literature. The invention will be further described in the following examples, which do not limit the scope of the methods and compositions of matter described in the claims.

EXAMPLES

Part A

Example 1

Six-Year Historical Data

Figure 1:
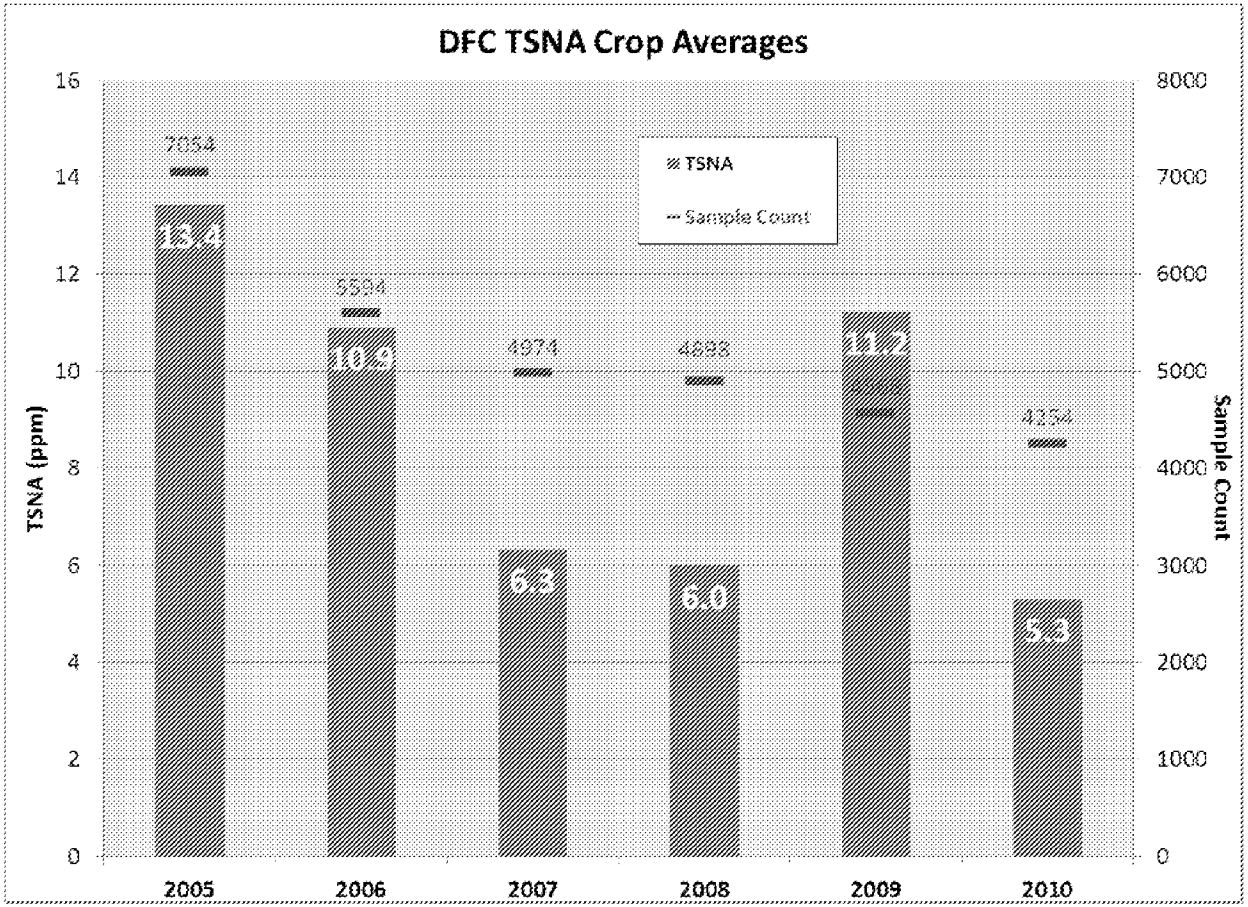
FIG. 1 is a graph showing TSNA levels in dark fire cured tobacco in Kentucky and Tennessee crops over a 6-year period of time.
Figure 2:
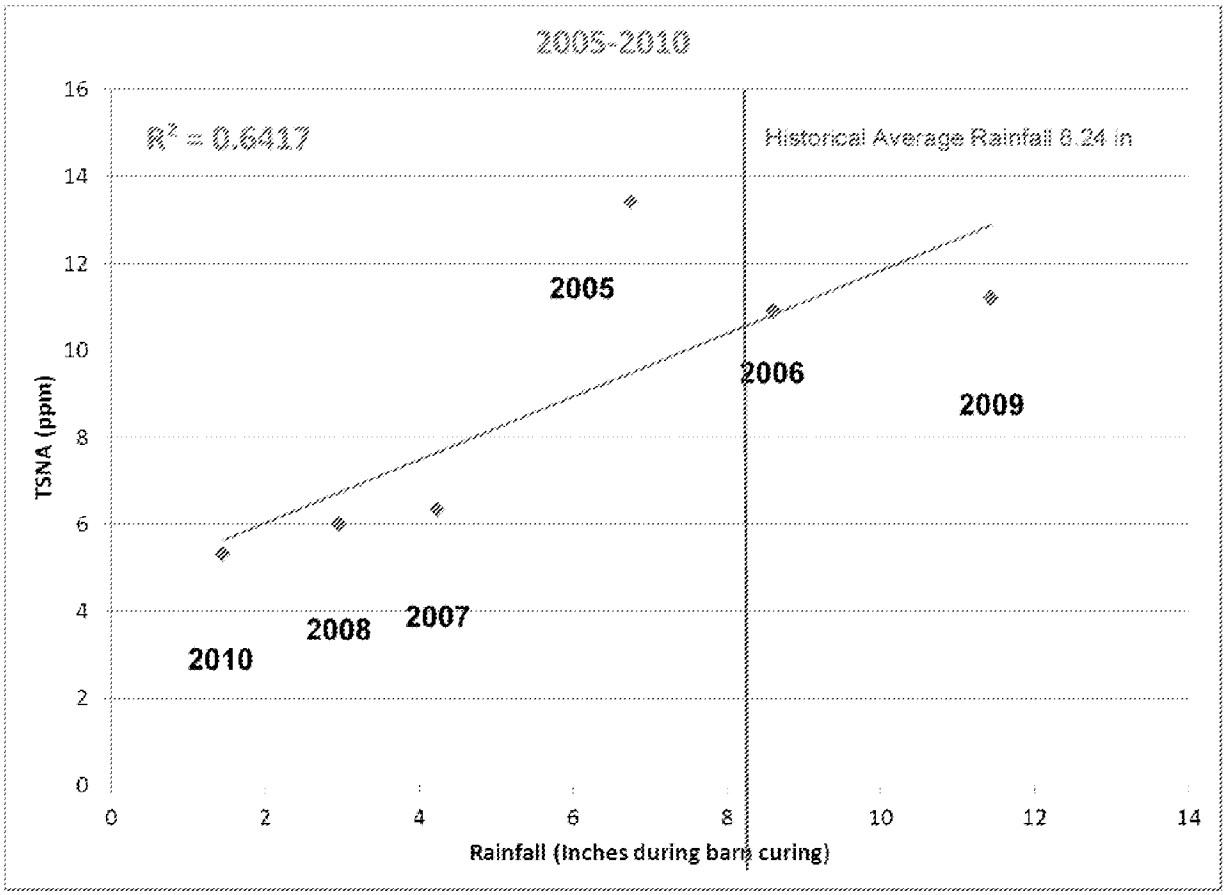
FIG. 2 is a graph showing TSNA levels each year relative to the rainfall received during the curing time.

End of cure TSNA levels were characterized in dark fire-cured tobacco in Kentucky and Tennessee over six growing seasons (2005-2010). Information was collected on agronomic and curing practices used by the growers, and the temperature and relative humidity profiles were monitored in 30 to 80 individual dark fire-cure barns per year. Over the six-year period, mean measurements for total TSNA levels in dark fire-cured tobacco were between a high of 13.4 ppm in 2005 and a low of 5.3 ppm in 2010 (FIG. 1). A general relationship ($r^2$=0.6417) between TSNA levels and average rainfall following housing was observed (FIG. 2).

Figure 3A:
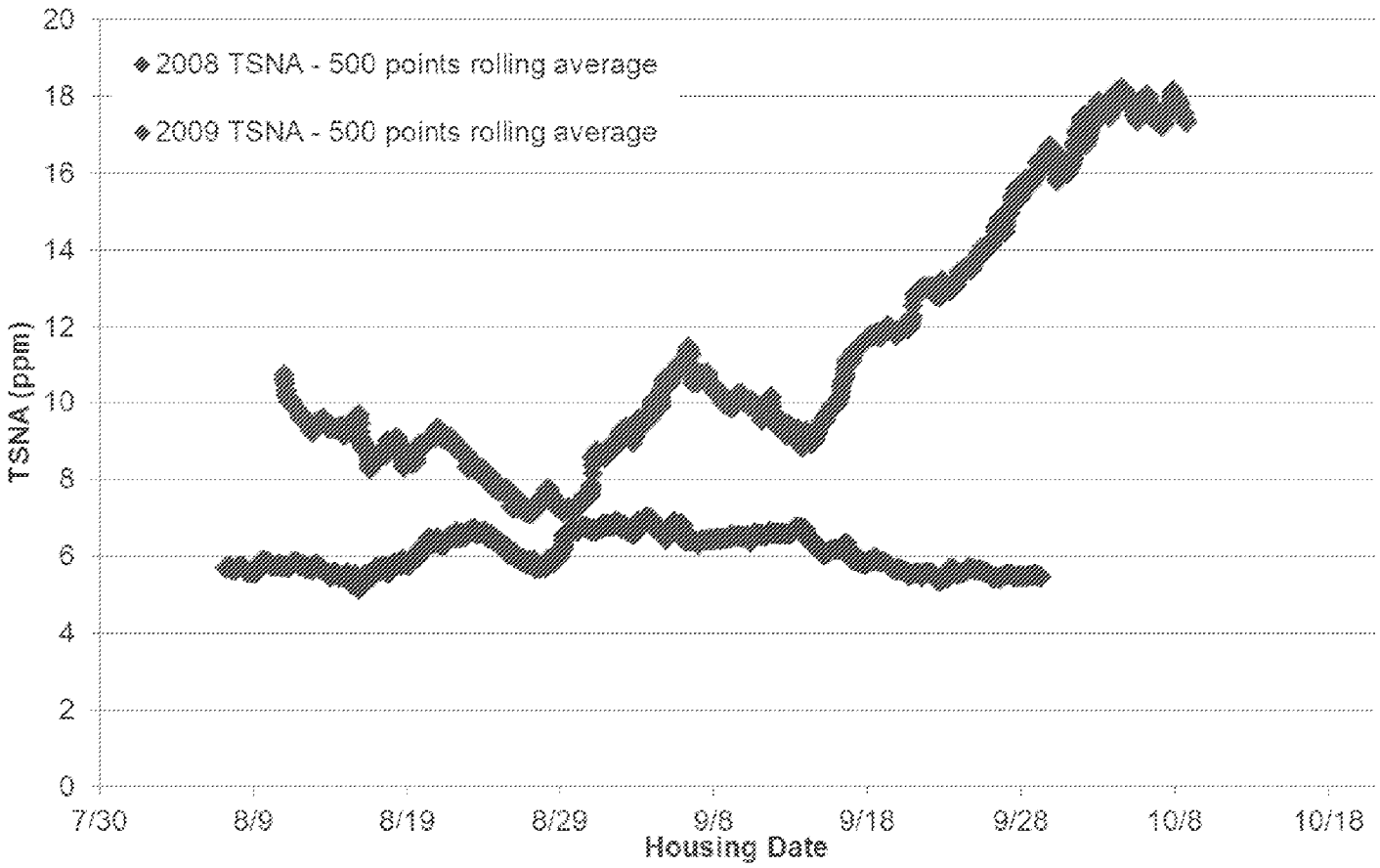
FIG. 3A shows TSNA levels following housing in two growing seasons (i.e., 2008 and 2009).
Figure 3B:
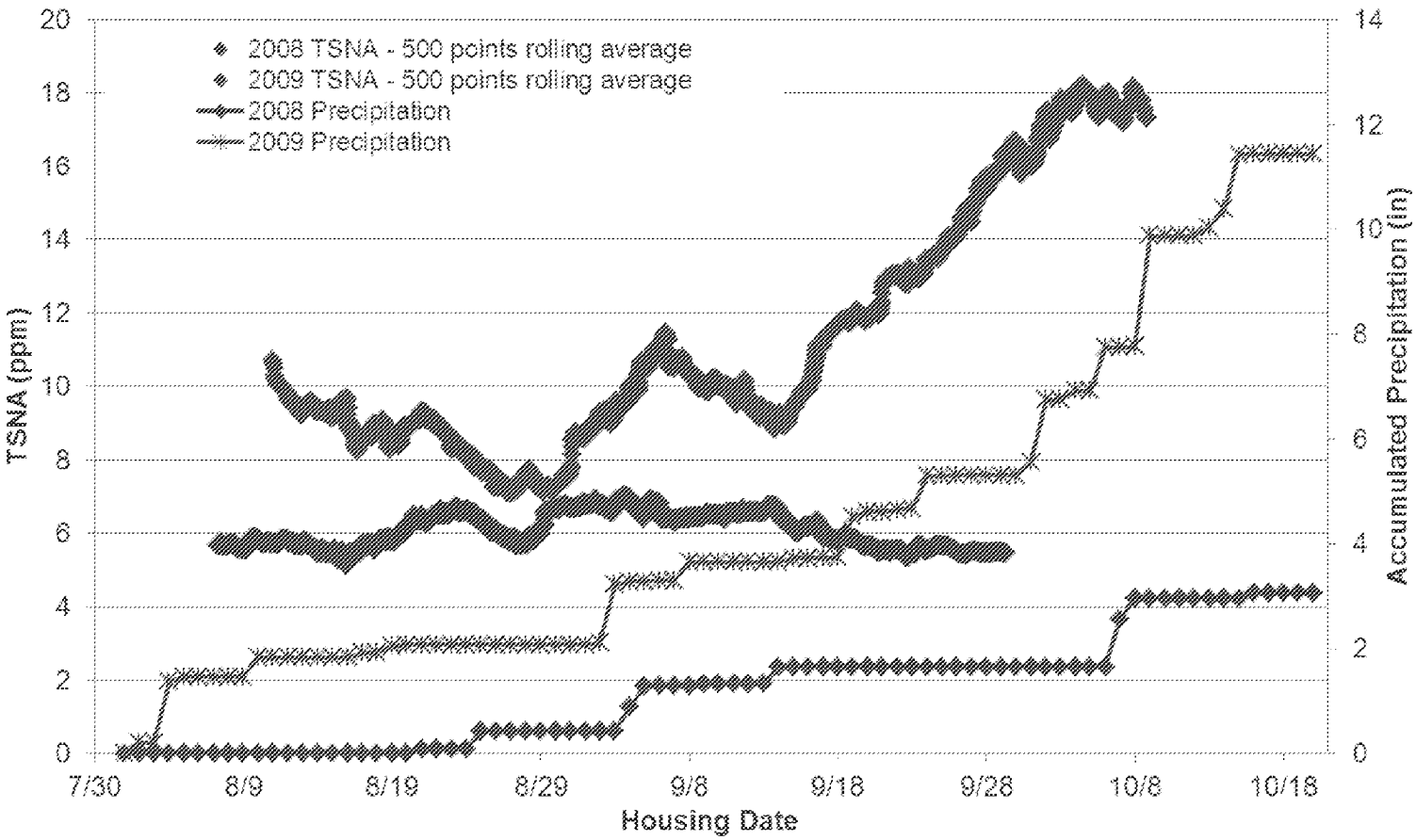
FIG. 3B shows TSNA levels following housing in the same two growing seasons graphed relative to the amount of precipitation receiving over the same time.

FIG. 3A shows the TSNA levels in dark fire-cured tobacco following housing in the 2008 and 2009 growing season, while FIG. 3B includes the amount of precipitation received over that same period of time. The "500 points rolling average" refers to a data set created by 1) matching every TSNA value with the corresponding housing date for the barn from which the tobacco came; 2) sorting by the housing date such that the earliest housing date with its corresponding TSNA value is, e.g., at the top and the latest housing date with its corresponding TSNA value is, e.g., at the bottom; and 3) creating each data point by averaging housing dates #1-500 and TSNA values #1-500, housing dates #2-501 and TSNA values #2-501, etc., etc. in order to reduce the background noise of the data.

Figure 4:
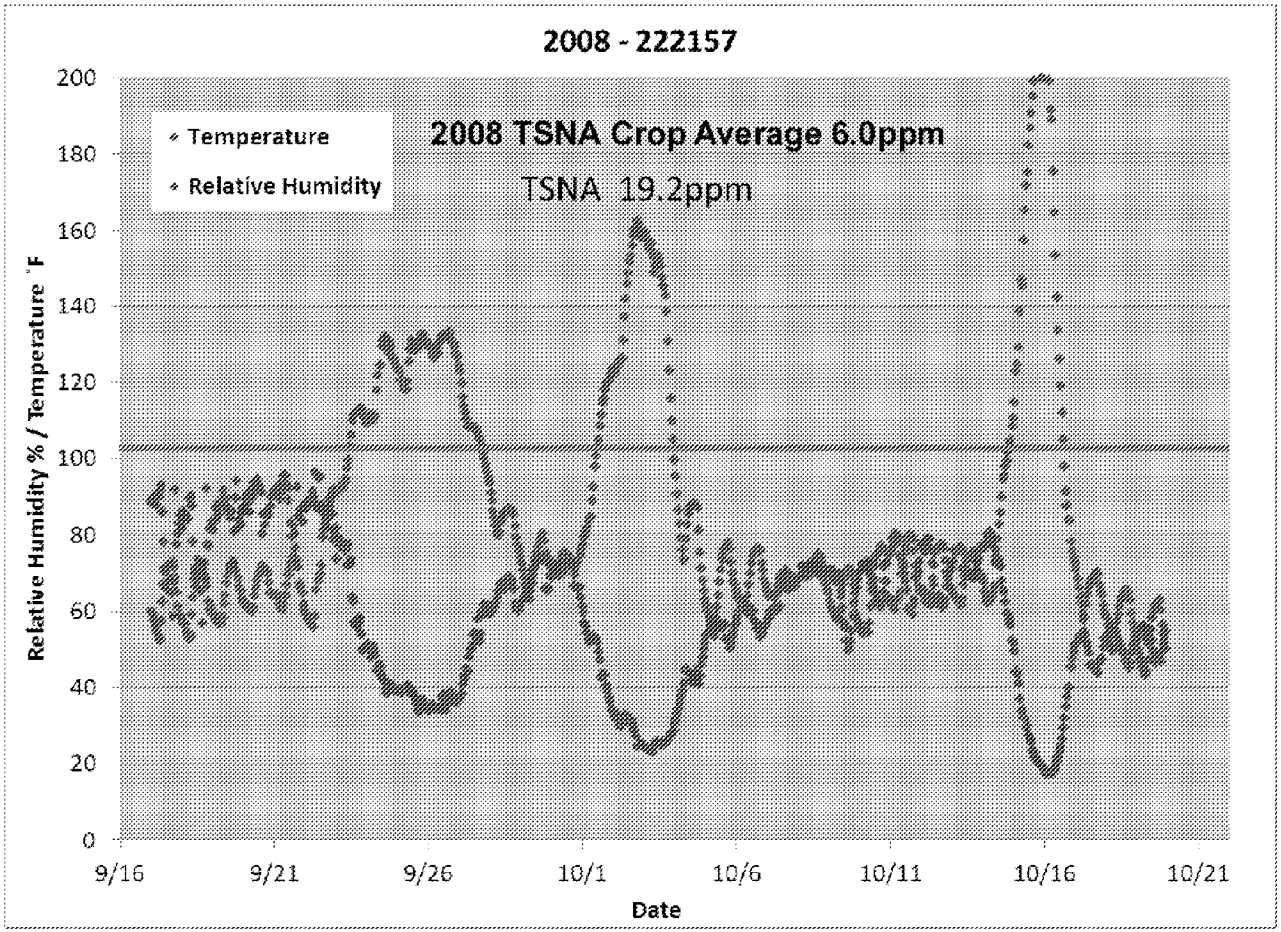
FIG. 4 is a graph showing the percent relative humidity (red) and the temperature (blue) in a single barn following housing of the tobacco after the 2008 growing season. The barn from which this data was obtained was selected because it produced dark fire-cured tobacco having 19.2 ppm TSNAs in a year when the average TSNA level was 6.0 ppm.
Figure 5:
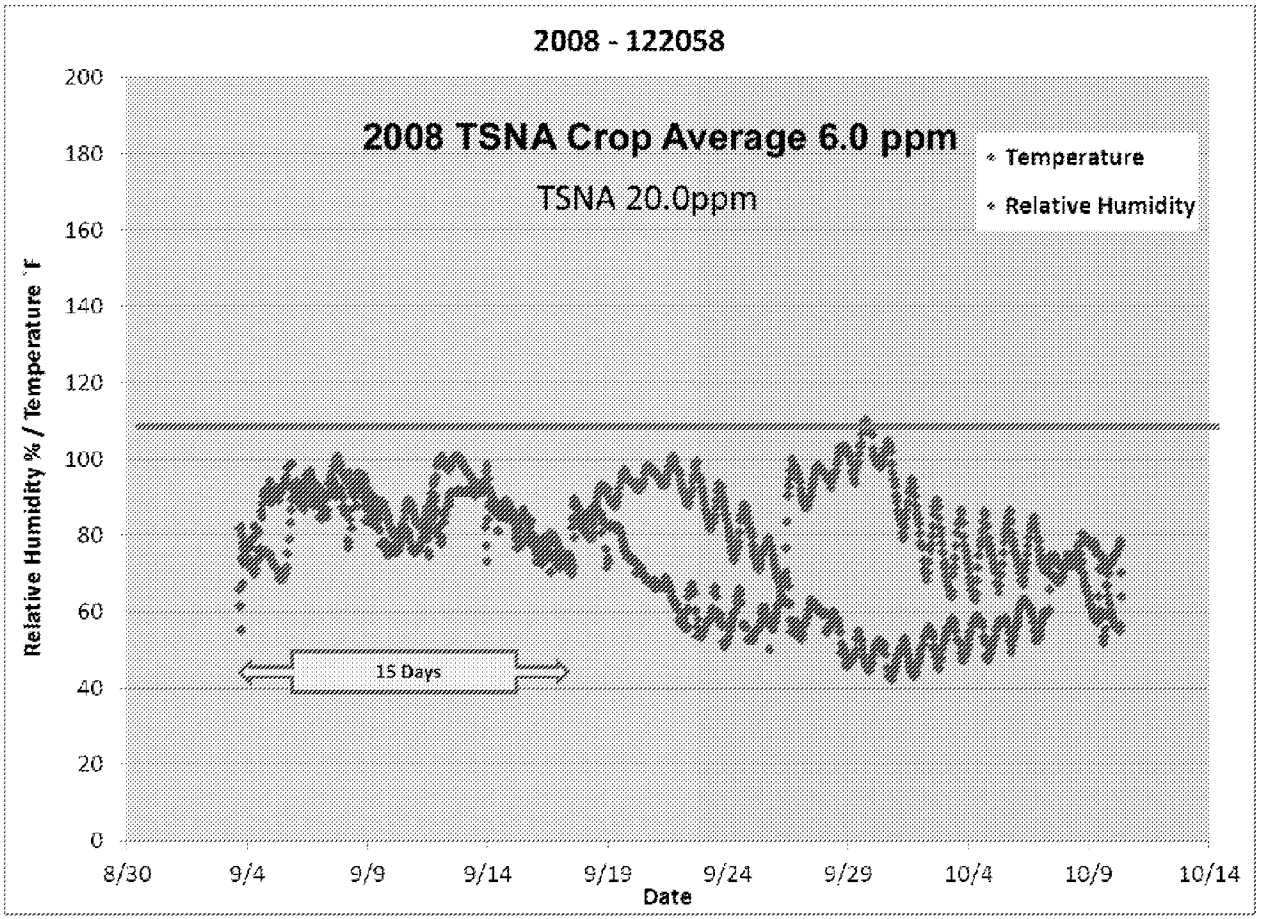
FIG. 5 is a graph showing the percent relative humidity (red) and the temperature (blue) in a single barn following housing of the tobacco after the 2008 growing season. The barn from which this data was obtained was selected because it produced dark fire-cured tobacco having 20.0 ppm TSNAs in a year when the average TSNA level was 6.0 ppm.
Figure 6:
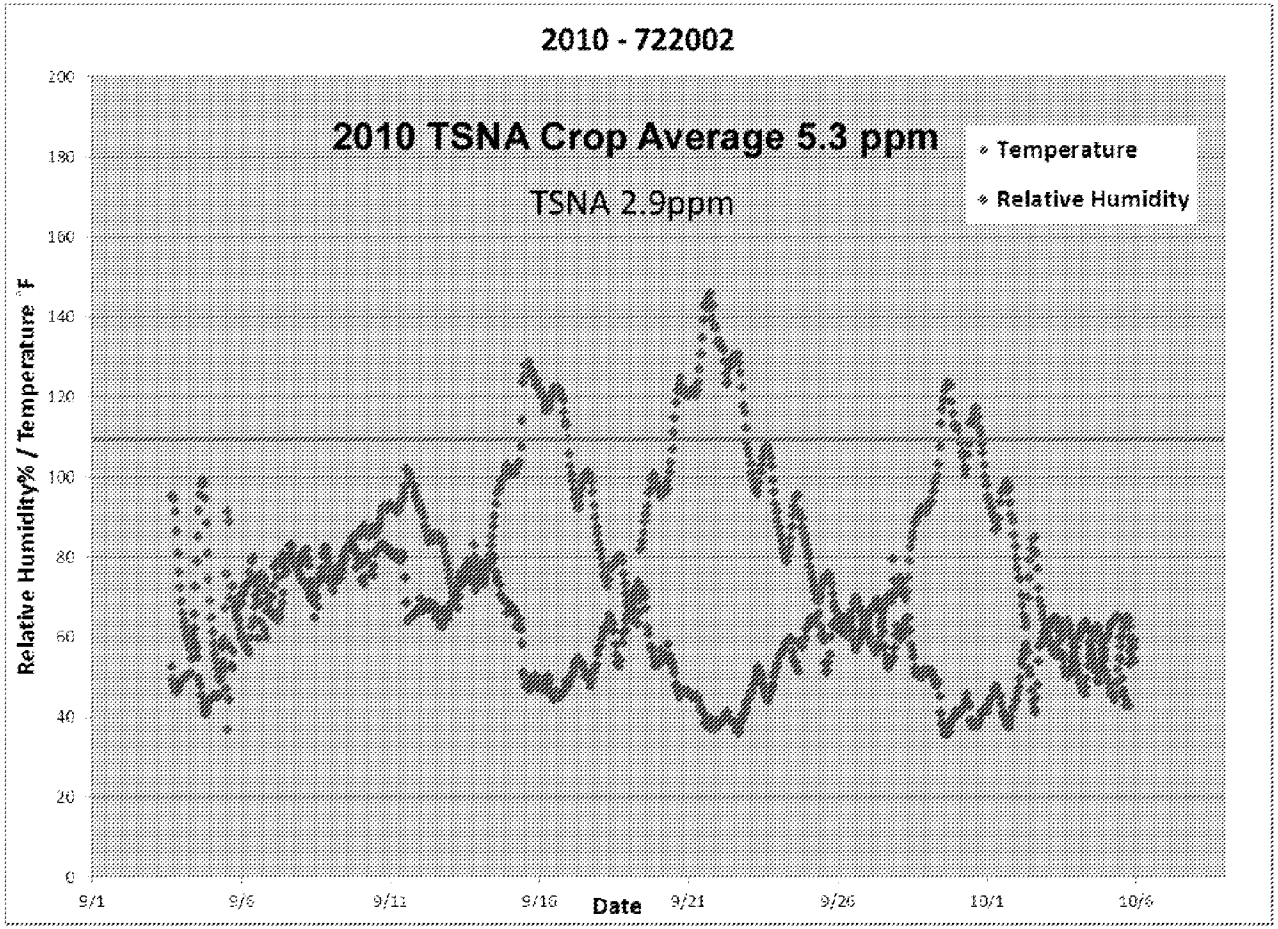
FIG. 6 is a graph showing the percent relative humidity (red) and the temperature (blue) in a single barn following housing of the tobacco after the 2010 growing season. The barn from which this data was obtained was selected because it produced dark fire-cured tobacco having 2.9 ppm TSNAs in a year when the average TSNA level was 5.3 ppm.
Figure 7:
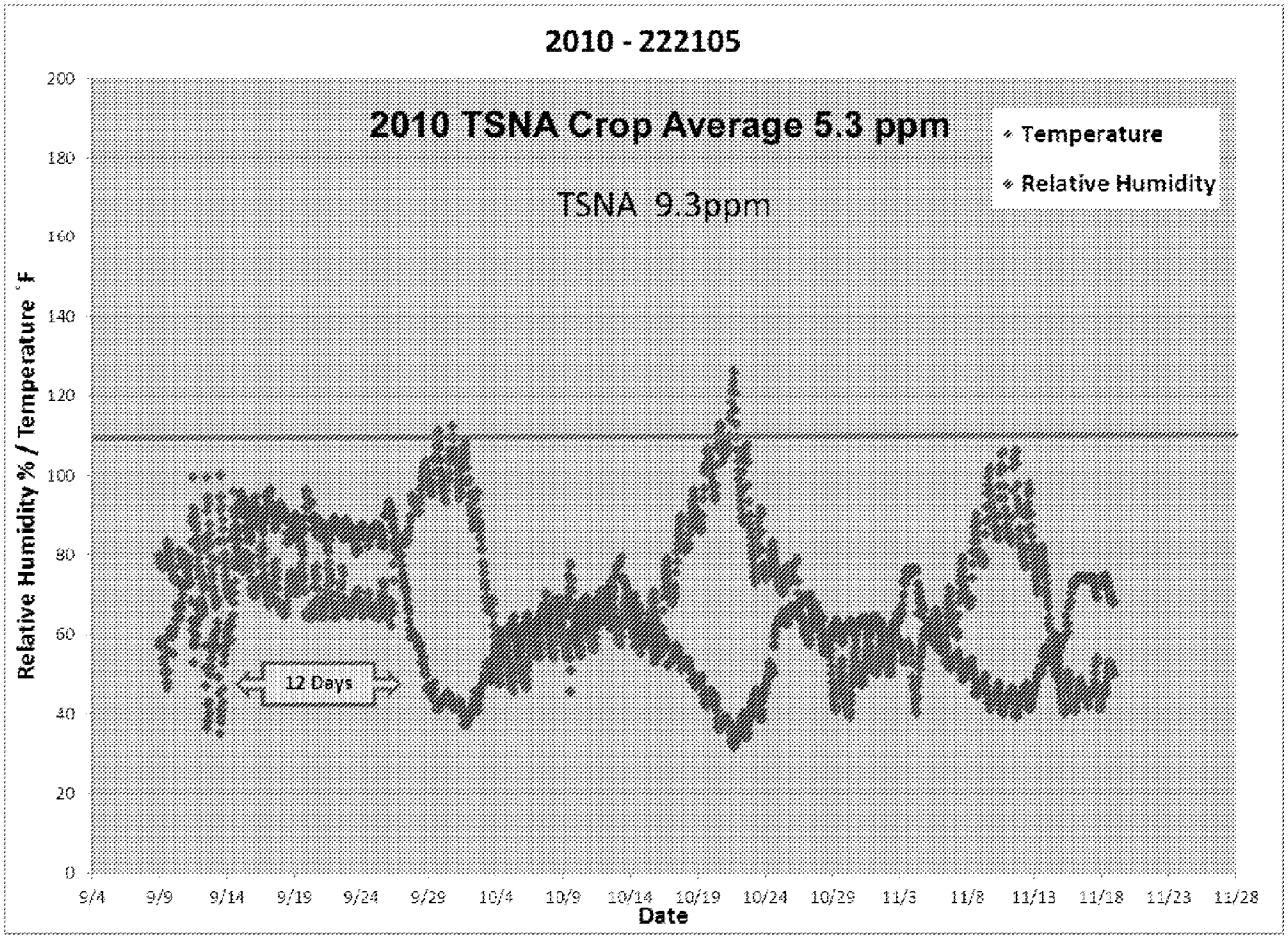
FIG. 7 is a graph showing the percent relative humidity (red) and the temperature (blue) in a single barn following housing of the tobacco after the 2010 growing season. The barn from which this data was obtained was selected because it produced dark fire-cured tobacco having 9.3 ppm TSNAs in a year when the average TSNA level was 5.3 ppm.

Each of FIGS. 4 and 5 show the temperature and percent relative humidity from one barn following housing of dark tobacco in the 2008 season. In a year in which the average TSNA levels in dark fire-cured tobacco were 6.0 ppm, the dark fire-cured tobacco from the barn shown in FIG. 4 had TSNA levels of 19.2 ppm and the dark fire-cured tobacco from the barn shown in FIG. 5 had TSNA levels of 20.0 ppm. Similarly, each of FIGS. 6 and 7 show the temperature and percent relative humidity from one barn following housing of dark tobacco in the 2010 season. In a year in which the average TSNA levels in dark fire-cured tobacco were 5.3 ppm, the dark fire-cured tobacco from the barn shown in FIG. 6 had TSNA levels of 2.9 ppm, and the dark fire-cured tobacco from the barn shown in FIG. 7 had TSNA levels of 9.3 ppm.

Example 2

Analysis of Data

When temperature and percent relative humidity profiles were evaluated with respect to the TSNA levels for each barn and as a crop average for the season, it was determined that growers that increased the temperature (e.g., started the first fire) immediately after housing the tobacco or up to within about 48 hours after housing the tobacco produced dark fire-cured tobacco that has reduced levels of TSNAs.

The data reported herein confirm that, during curing, the temperature as well as the relative humidity, which can be affected, at least in part, by the amount, timing and frequency of rainfall, have a direct impact on the TSNA levels of dark fire-cured tobacco.

Example 3

Results

Dark tobacco was fire-cured in a barn using the methods described herein (i.e., Barn1) or using conventional curing methods (i.e., Barn2) and the TSNA levels in the cured tobacco was compared.

Figure 8A:
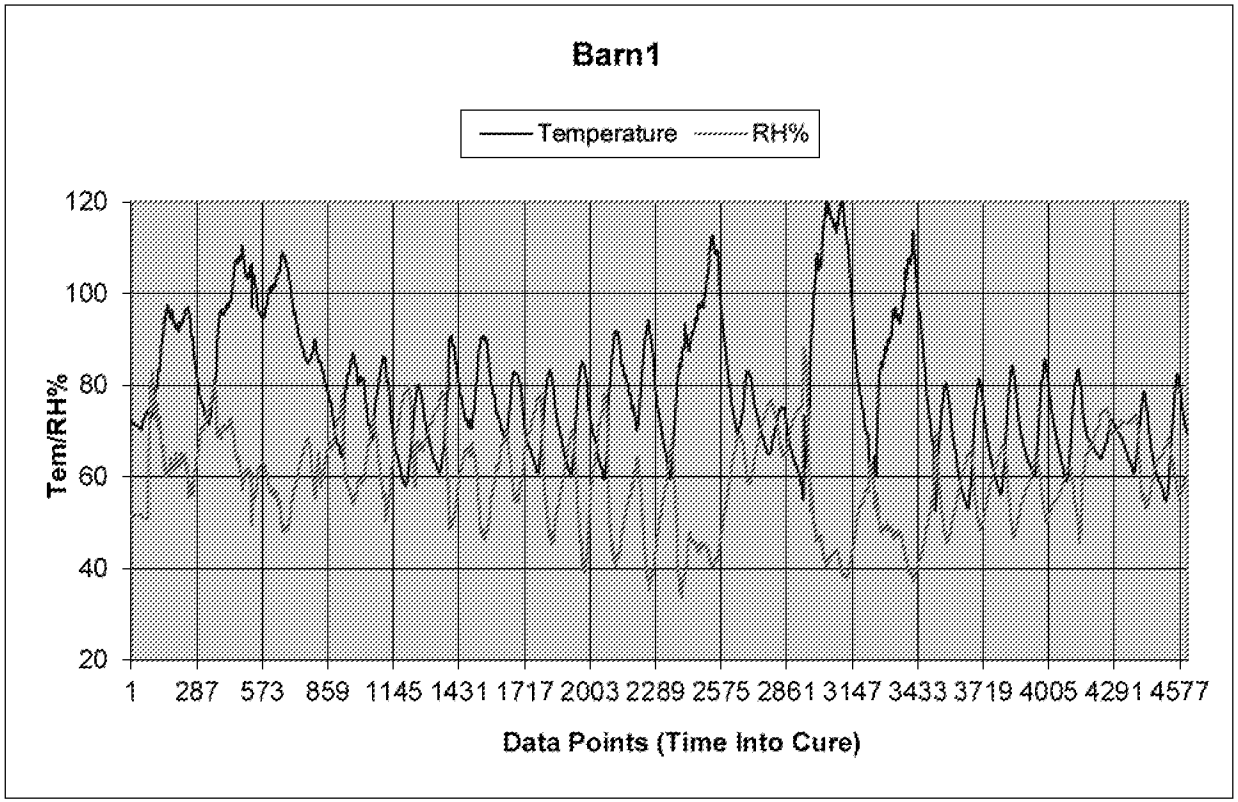
Figure 8B:
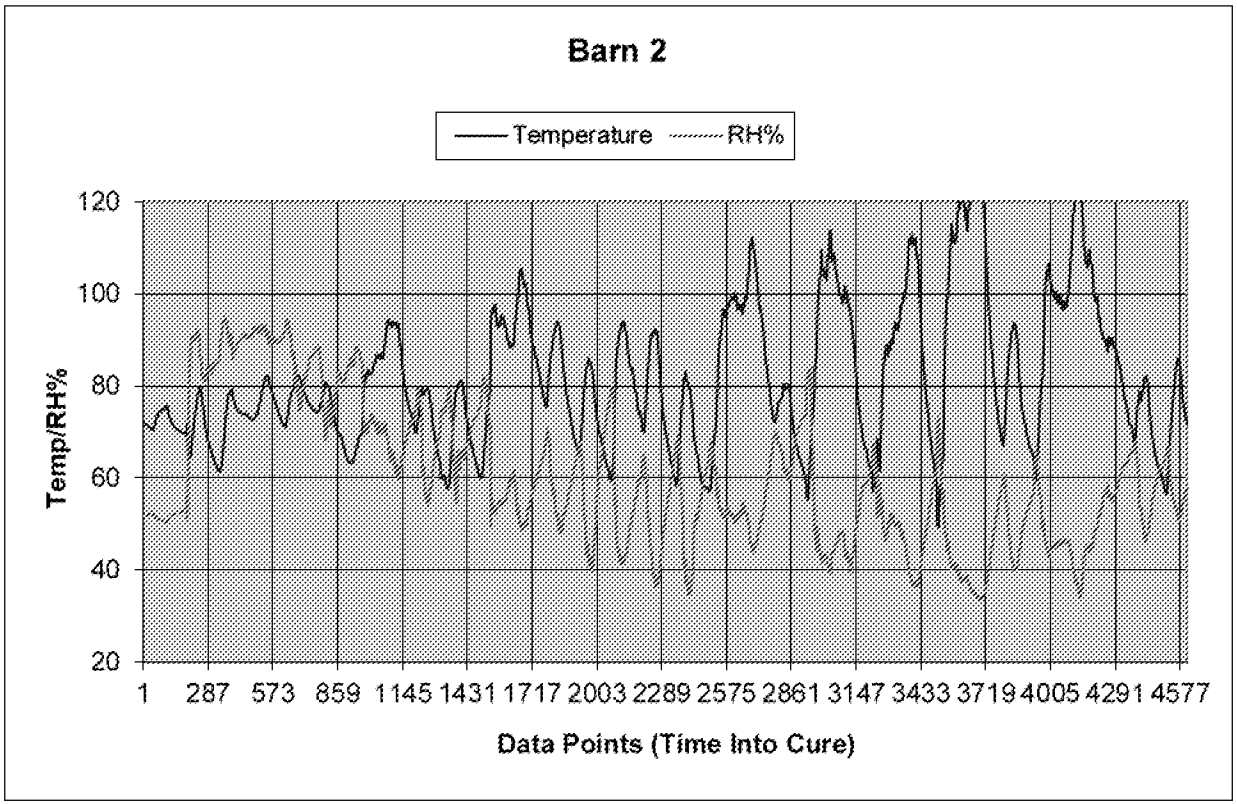
FIG. 8B shows the temperature and percent relative humidity in Barn2.

FIG. 8A shows the temperature and percent relative humidity in Barn1, in which the fires were started immediately (i.e., within several hours) after housing, while FIG. 8B shows the temperature and percent relative humidity in Barn2, in which the fires were started about 6 days after housing. Temperature and relative humidity data was obtained from each barn every 10 minutes. As can be seen from the data, the relative humidity in Barn1 was kept below about 80%, and often below about 60%, during the first week of curing (FIG. 8A). However, the relative humidity in Barn2 remained quite high (e.g., >90%) during the first week of curing.

Figure 8C:
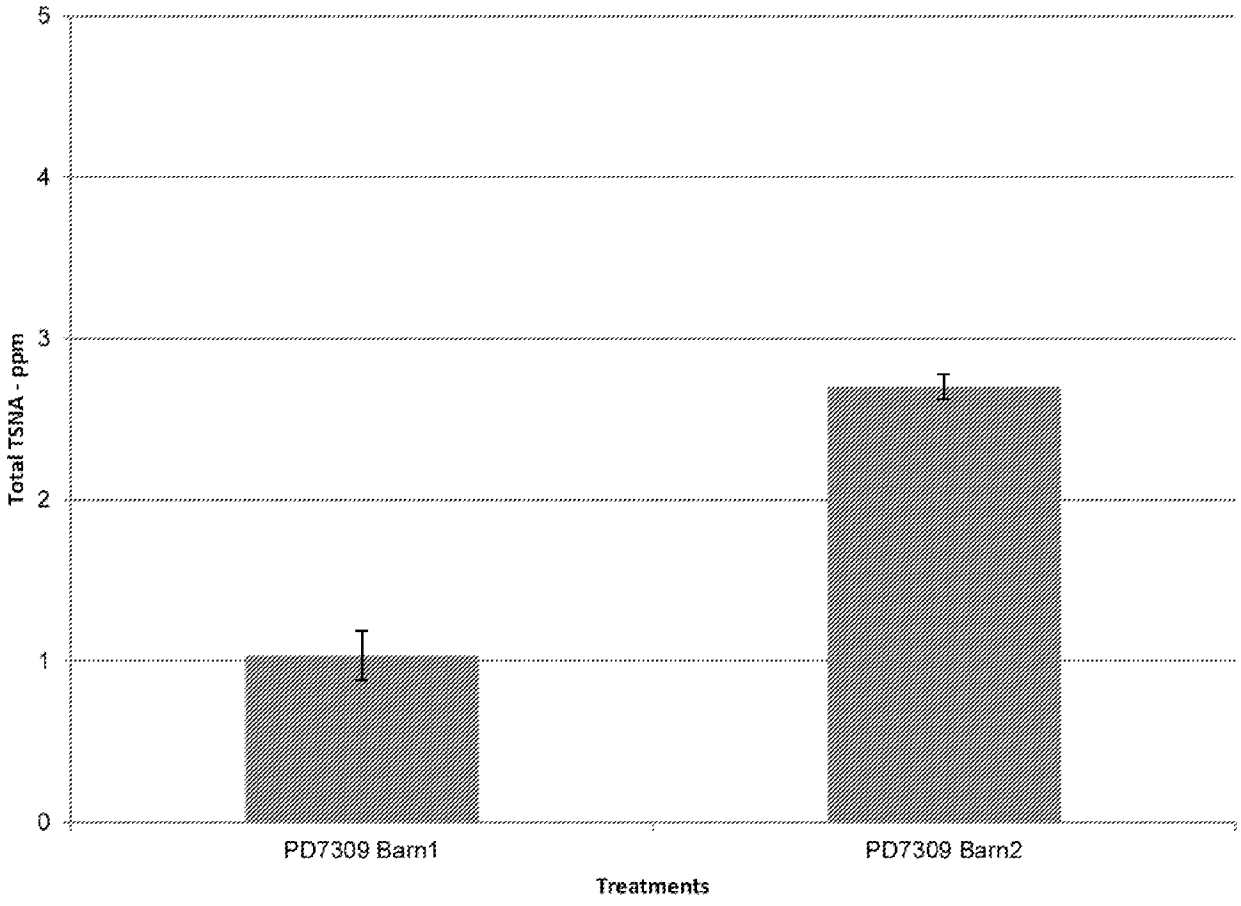
FIG. 8C is a graph showing the TSNA levels in Barn1 and Barn2.

FIG. 8C is a graph showing the TSNA levels in Barn1 and Barn2. Notably, the TSNA levels in Barn1 were statistically significantly less than the TSNA levels in Barn2. Thus, the methods described herein can be used to reduce the TSNA levels in dark fire-cured tobacco. The results reported herein confirm that controlling the temperature and relative humidity during curing, particularly during the first week, and particularly during the first 48 hours, can impact TSNA content in the leaf of dark fire-cured tobacco.

Part B

Example 4

Curing Dark Tobacco

Dark tobacco was harvested from the field and housed in a barn for air curing. The barn was closed in order to create a non-ventilated environment (e.g., to artificially maintain the humidity). FIG. 9 shows the relative water activity in the tobacco leaves following the indicated number of days after the tobacco was housed in the barn. As can be seen, it took more than three weeks after the tobacco was housed for the relative water activity to fall below 0.9. Therefore, air-curing conditions would have supported the growth of bacteria (e.g., nitrate-reducing bacteria) for more than three weeks after the tobacco was housed in the barn.

Dark tobacco was harvested from the field and placed in the barn for fire curing. FIG. 10A shows that it took between 6 and 11 days after the tobacco was housed in the barn for the relative water activity to fall below 0.9. Therefore, compared to the air-curing shown in FIG. 9, fire-curing dark tobacco resulted in a faster reduction in the relative water activity. FIG. 10B shows the temperature and relative humidity in the barn overlaid on the relative water activity from FIG. 10A (triangles). The fires, indicated by the peaks in the temperature graph (e.g., at about 6, 26, 29 and 47 days after housing), were consistent with a steady decline in the relative water activity.

Example 5

Traits to Improve Leaf Quality of Dark Tobacco

FIG. 11A shows the temperature and relative humidity during the fire-curing of dark tobacco. In Barn1, the initial fires were started about 5 to 6 days after housing the tobacco ("conventional" or "standard" curing), while in Barn2, the initial fires were started within 48 hours after housing the tobacco ("flash" curing).

FIG. 11B is a graph showing the quality of the dark tobacco leaves following curing in Barn1 or Barn2. KY171 is a commercial variety of dark tobacco; TRM181 is a commercial variety of dark tobacco that also is a converter line (i.e., capable of converting nicotine to nornicotine; see, for example, WO 2008/076802); and PY KY171 is a variety containing the pale yellow (PY) trait. See, for example, Legg, 1995, *Crop Sci.*, 35:601-2. Leaves were obtained from stalk position C, and their average grade index was determined based on Federal Grade and 2004 Price Support for Type 23 Western dark-fired tobacco. FIG. 11B shows that, under "conventional" curing conditions (e.g., starting the initial fires 6-8 days after housing), the pale yellow trait had little to no effect, but under "flash" curing conditions (e.g., starting the initial fires within 48 hours after housing), the pale yellow trait resulted in a significant improvement in the leaf quality of the dark tobacco.

FIG. 11C is a graph in which the results shown in FIGS. 11A and 11B are expressed relative to TSNA levels; the inset in FIG. 11C shows the same data absent the converter line, so as to more clearly see that the pale yellow trait has little to no effect on the TSNA levels in the leaf.

It is to be understood that, while the methods and compositions of matter have been described herein in conjunction with a number of different aspects, the foregoing description of the various aspects is intended to illustrate and not limit the scope of the methods and compositions of matter. Other aspects, advantages, and modifications are within the scope of the following claims.

Disclosed are methods and compositions that can be used for, can be used in conjunction with, can be used in preparation for, or are products of the disclosed methods and compositions. These and other materials are disclosed herein, and it is understood that combinations, subsets, interactions, groups, etc. of these methods and compositions are disclosed. That is, while specific reference to each various individual and collective combinations and permutations of these compositions and methods may not be explicitly disclosed, each is specifically contemplated and described herein. For example, if a particular composition of matter or a particular method is disclosed and discussed and a number of compositions or methods are discussed, each and every combination and permutation of the compositions and the methods are specifically contemplated unless specifically indicated to the contrary. Likewise, any subset or combination of these is also specifically contemplated and disclosed.

What is claimed is:

1. A method of fire curing harvested tobacco comprising:
housing harvested tobacco in a curing barn; and
reducing the relative humidity in the barn to 80% or less within 12 hours of the housing step.

2. The method of claim 1, wherein the relative humidity in the barn is reduced to 75% or less within 12 hours of the housing step.

3. The method of claim 1, wherein the relative humidity in the barn is reduced to 70% or less within 12 hours of the housing step.

4. The method of claim 1, wherein the method reduces the level of at least one TSNA in the cured tobacco.

5. The method of claim 4, wherein the at least one TSNA is selected from the group consisting of N'-nitrosonornicotine (NNN), 4-(N-nitrosomethylamino)-1-(3-pyridyl)-1-butanone (NNK), N'-nitrosoanatabine (NAT) and N'-nitrosoanabasine (NAB).

6. The method of claim 1, wherein the tobacco is dark fire-cured.

7. The method of claim 1, wherein the tobacco is partially yellowed at the housing step.

8. The method of claim 1, wherein the tobacco is pale-yellow tobacco.

9. The method of claim 1, wherein the tobacco comprises a pale-yellow gene.

10. A method of fire curing harvested tobacco comprising:
housing tobacco in a curing barn; and
drying tobacco under conditions that reduce the level of at least one tobacco-specific nitrosamine (TSNA), wherein the conditions comprise increasing the temperature and decreasing the percent relative humidity to less than 80% within 12 hours of the housing step.

11. The method of claim 10, wherein the at least one TSNA is selected from the group consisting of N'-nitrosonornicotine (NNN), 4-(N-nitrosomethylamino)-1-(3-pyridyl)-1-butanone (NNK), N'-nitrosoanatabine (NAT) and N'-nitrosoanabasine (NAB).

12. The method of claim 10, wherein the tobacco is dark fire-cured.

13. The method of claim 10, wherein the tobacco is partially yellowed at the housing step.

14. The method of claim 10, wherein the tobacco is pale-yellow tobacco.

15. The method of claim 10, wherein the tobacco comprises a pale-yellow gene.

16. A method of fire curing harvested tobacco comprising:
housing harvested tobacco in a curing barn;
starting fires in the curing barn within 48 hours of the housing step; and
reducing the relative water activity in the tobacco to 0.9 or less within one to three weeks of the housing step.

17. The method of claim 16, wherein the relative water activity in the tobacco is reduced to 0.85 or less within one to three weeks of the housing step.

18. The method of claim 16, wherein the relative water activity in the tobacco is reduced to 0.80 or less within one to three weeks of the housing step.

19. The method of claim 16, wherein the method reduces the level of at least one TSNA in the cured tobacco.

20. The method of claim 19, wherein the at least one TSNA is selected from the group consisting of N'-nitrosonornicotine (NNN), 4-(N-nitrosomethylamino)-1-(3-pyridyl)-1-butanone (NNK), N'-nitrosoanatabine (NAT) and N'-nitrosoanabasine (NAB).

21. The method of claim 16, wherein the tobacco is dark tobacco.

22. The method of claim 16, wherein the tobacco is partially yellowed at the housing step.

23. The method of claim 16, wherein the tobacco is pale-yellow tobacco.

24. The method of claim 16, wherein the tobacco comprises a pale-yellow gene.

* * * * *